US005267358A

United States Patent [19]

Roy et al.

[11] Patent Number: 5,267,358

[45] Date of Patent: Dec. 7, 1993

[54] SWIMMING POOL SAFETY NET APPARATUS

[76] Inventors: Mildred H. Roy; James L. Roy, Jr., both of 530 McKinley, Gary, Ind. 46404

[21] Appl. No.: 835,361

[22] Filed: Feb. 14, 1992

[51] Int. Cl.[5] ..... E04H 4/10

[52] U.S. Cl. ..... 4/504; 4/495; 4/503; 52/83

[58] Field of Search ..... 4/495, 496, 498, 503, 4/504; 52/169.7, 83

[56] References Cited

U.S. PATENT DOCUMENTS

| | | | |
|---|---|---|---|
| 1,796,762 | 3/1931 | Paston | 4/504 |
| 2,958,872 | 11/1960 | Meyer, Jr. | 4/503 |
| 3,045,253 | 7/1962 | Price | 4/504 |
| 3,046,566 | 7/1962 | Berman | 4/504 X |
| 3,184,764 | 5/1965 | West | 4/498 |
| 3,293,665 | 12/1966 | Langer | 4/503 |
| 3,593,757 | 7/1971 | Haynes | 4/498 X |
| 4,459,711 | 7/1984 | Sartain et al. | 4/498 X |
| 4,598,506 | 7/1986 | Nohl et al. | 4/498 X |
| 4,831,672 | 5/1989 | Niimura | 4/495 |
| 4,847,925 | 7/1989 | Perry | 4/498 X |

FOREIGN PATENT DOCUMENTS

| | | | |
|---|---|---|---|
| 0025740 | 12/1978 | Australia | 4/498 |
| 1263067 | 11/1989 | Canada | 4/498 |
| 1806673 | 5/1970 | Fed. Rep. of Germany | 4/504 |
| 1914286 | 10/1970 | Fed. Rep. of Germany | 4/495 |
| 0572849 | 2/1958 | Italy | 4/495 |
| 2056851 | 3/1981 | United Kingdom | 4/498 |

*Primary Examiner*—William A. Cuchlinski, Jr.
*Assistant Examiner*—John L. Beres
*Attorney, Agent, or Firm*—Leon Gilden

[57] ABSTRACT

An apparatus to include a flexible protective web mounted in a first position to a bottom surface of a swimming pool and in a second position raised adjacent an upper edge of a perimeter side of the swimming pool. The apparatus includes a primary control tube to include a housing. The housing formed with a plurality of shaft members, with the first shaft arranged to effect rotation relative to the housing and effect a winding of a primary control cable, with secondary control cables directed from the housing to secondary control tubes to effect simultaneous lifting of the web to the second position.

6 Claims, 4 Drawing Sheets

SWIMMING POOL SAFETY NET APPARATUS

BACKGROUND OF THE INVENTION

1. Field of the Invention

The field of invention relates to swimming pool apparatus, and more particularly pertains to a new and improved swimming pool safety net apparatus wherein the same is arranged to effect the lifting of a safety net from a first position to a second position to prevent inadvertent access to the swimming pool by individuals, and particularly children and the like.

2. Description of the Prior Art

To prevent access to a swimming pool by children that are attracted to a swimming pool to minimize inadvertent drowning as is available with residential and commercial type pools, the instant invention provides for a net structure arranged to be positioned relative to an upper portion of the swimming pool preventing access to the lower depths of the swimming pool. Prior art safety nets apparatus is set forth in the U.S. Pat. No. 4,129,905 to Niemirow wherein a swimming rescue net is arranged by use of an inflatable bladder to be lifted to a raised orientation within the swimming pool.

U.S. Pat. No. 3,423,768 to Glenn sets forth a safety platform for swimming pools arranged for lifting by pneumatic pressure within the swimming pool.

The U.S. Pat. Nos. 3,369,977 and 3,229,309 set forth further examples of swimming pool covers arranged for mounting relative to an associated swimming pool structure.

Accordingly, it may be appreciated there continues to be a need for a new and improved swimming pool safety net apparatus as set forth by the instant invention which addresses the problems of ease of use as well as effectiveness in construction and in this respect, the present invention substantially fulfills this need.

SUMMARY OF THE INVENTION

In view of the foregoing disadvantages inherent in the known types of swimming pool apparatus now present in the prior art, the present invention provides a swimming pool safety net apparatus wherein the same is arranged to permit lifting of a swimming pool to a raised orientation of the swimming pool preventing undesirable access into the swimming pool by children. As such, the general purpose of the present invention, which will be described subsequently in greater detail, is to provide a new and improved swimming pool safety net apparatus which has all the advantages of the prior art swimming pool apparatus and none of the disadvantages.

To attain this, the present invention provides an apparatus to include a flexible protective web mounted in a first position to a bottom surface of a swimming pool and in a second position raised adjacent an upper edge of a perimeter side of the swimming pool. The apparatus includes a primary control tube to include a housing. The housing formed with a plurality of shaft members, with the first shaft arranged to effect rotation relative to the housing and effect a winding of a primary control cable, with secondary control cables directed from the housing to secondary control tubes to effect simultaneous lifting of the web to the second position.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swimming pool safety net apparatus which has all the advantages of the prior art swimming pool apparatus and none of the disadvantages.

It is another object of the present invention to provide a new and improved swimming pool safety net apparatus which may be easily and efficiently manufactured and marketed.

It is a further object of the present invention to provide a new and improved swimming pool safety net apparatus which is of a durable and reliable construction.

An even further object of the present invention is to provide a new and improved swimming pool safety net apparatus which is susceptible of a low cost of manufacture with regard to both materials and labor, and which accordingly is then susceptible of low prices of sale to the consuming public, thereby making such swimming pool safety net apparatus economically available to the buying public.

Still yet another object of the present invention is to provide a new and improved swimming pool safety net apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
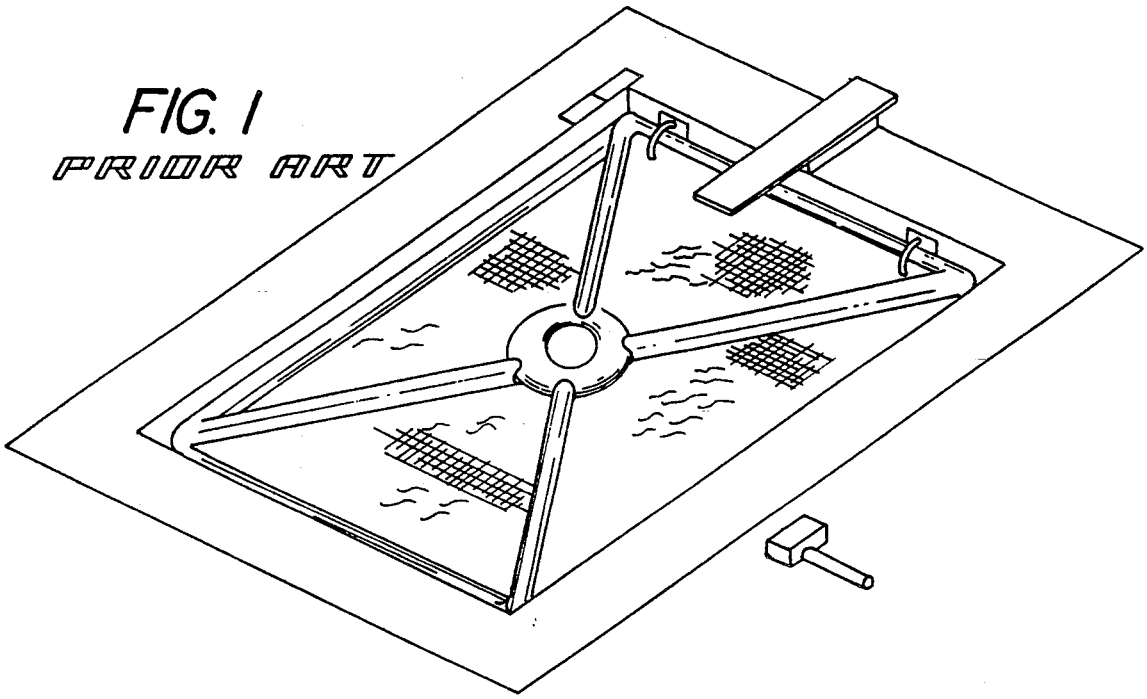
FIG. 1 PRIOR ART
FIG. 1 is an isometric illustration of a prior art safety net structure for use in a swimming pool.
Figure 2:
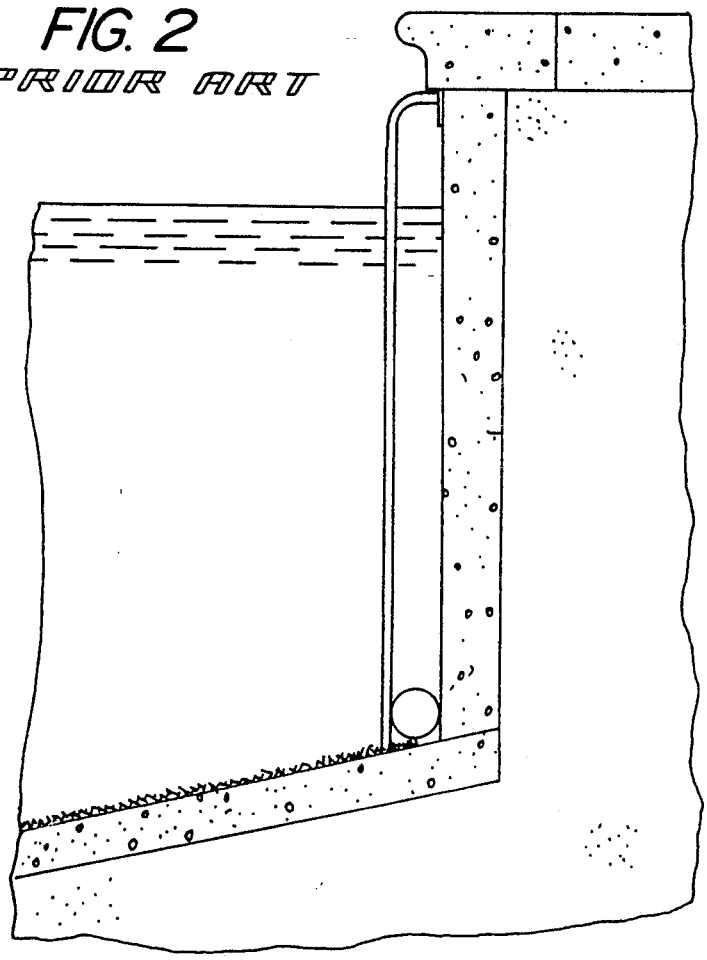
FIG. 2 PRIOR ART
FIG. 2 is an orthographic cross-sectional illustration of the prior art swimming pool structure as set forth in FIG. 1.
Figure 3:
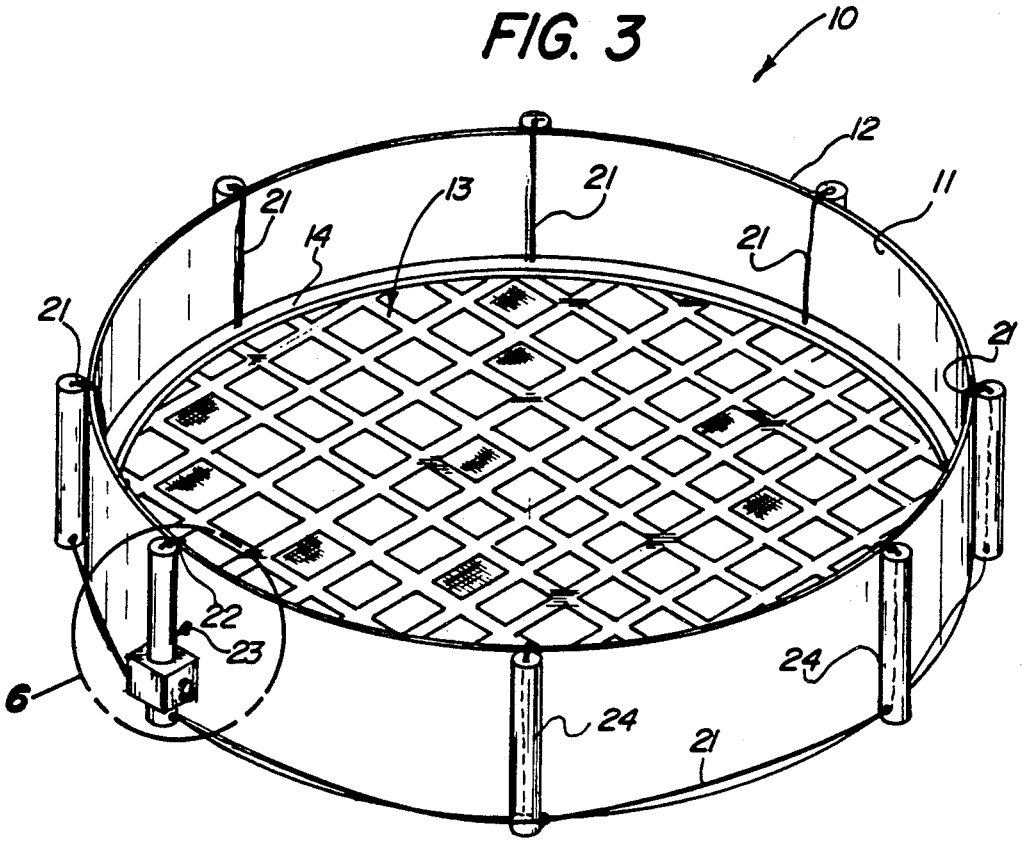
FIG. 3 is an isometric illustration of the instant invention.

With reference now to the drawings, and in particular to FIGS. 1 to 8 thereof, a new and improved swimming pool safety net apparatus embodying the principles and concepts of the present invention and generally designated by the reference numeral 10 will be described.

More specifically, the swimming pool safety net apparatus 10 of the instant invention essentially comprises a swimming pool formed with a continuous side wall 11 defined by a continuous top edge 12 and a floor 14. A protective mesh 13 of flexible construction is positioned upon the floor 14 in a first position and raised to a second position adjacent the top edge 12.

Figure 4:
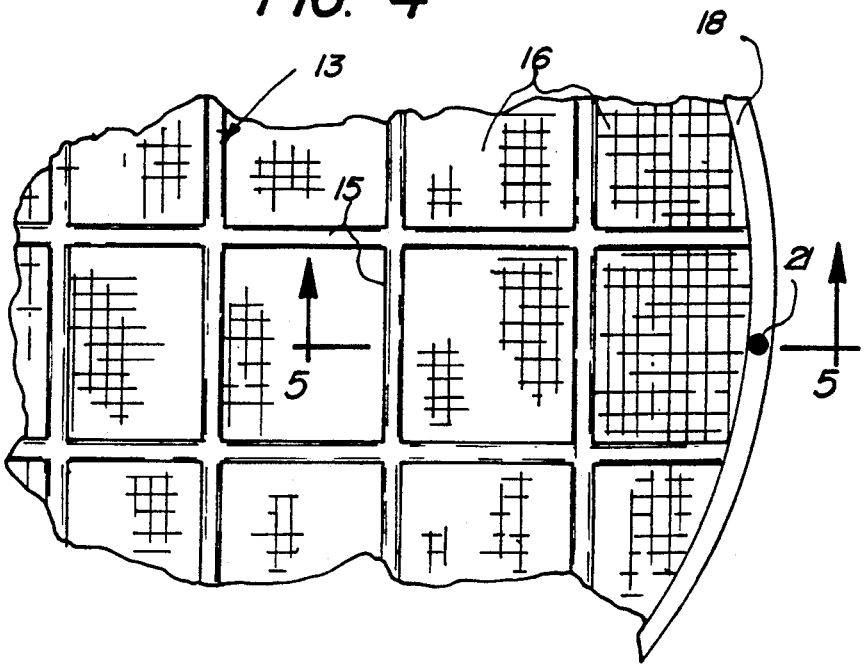
FIG. 4 is an orthographic top view, somewhat enlarged, of the safety net structure.
Figure 5:
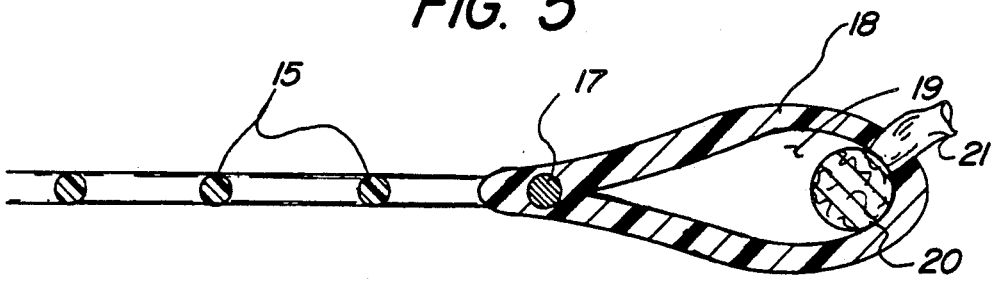
FIG. 5 is an orthographic view, taken along the lines 5—5 of FIG. 4 in the direction indicated by the arrows.

The protective web 13 includes intersecting flexible cables 15 (see FIGS. 4 and 5) including a matrix of mesh web panels 16 within the intersections of the cables 15, as illustrated in FIG. 4 for example. The web 13 is formed with an inner perimeter cable 17 arranged in surrounding continuous relationship relative to the mesh panels 16 and the flexible cables 15, wherein the inner perimeter cable 17 is positioned at a first end of a perimeter cable sheath 18, including a sheath cavity 19 therewithin. The sheath cavity 19 includes an outer cable 20 positioned therewithin in fixed communication to a plurality of secondary control cables 21 projecting from the outer perimeter cable 20 to an associated secondary control tube 24. A single primary cable 22 mounted to the outer perimeter cable 20 in a like manner as illustrated in FIG. 5 relative to the secondary control cable 21 is received within a primary control tube 23.

The primary control tube 23 includes a tube upper portion 25 coaxially aligned with a tube lower portion 26. A control housing 27 is positioned in surrounding relationship medially of the intersection of the tube upper portion 25 and the tube lower portion 26.

Figure 6:
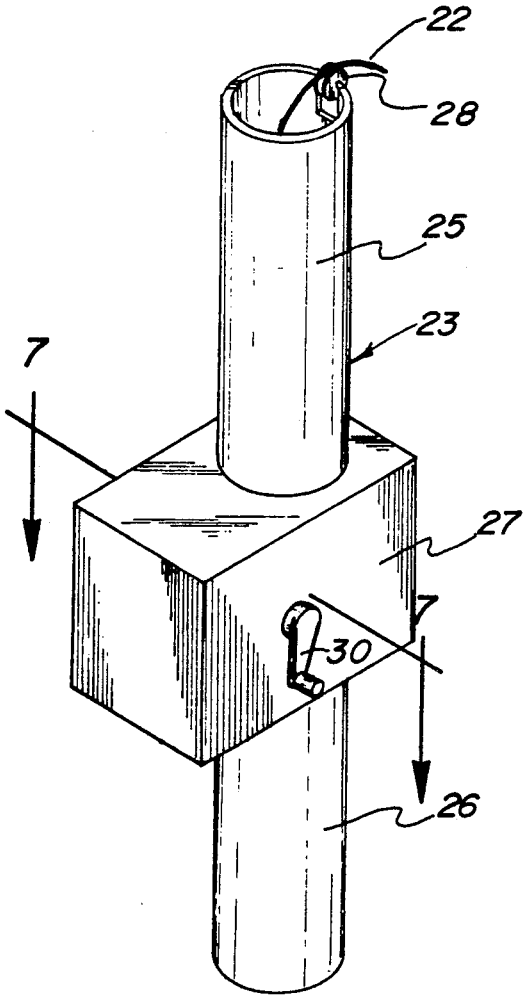
FIG. 6 is an isometric illustration of section 6, as set forth in FIG. 3.
Figure 7:
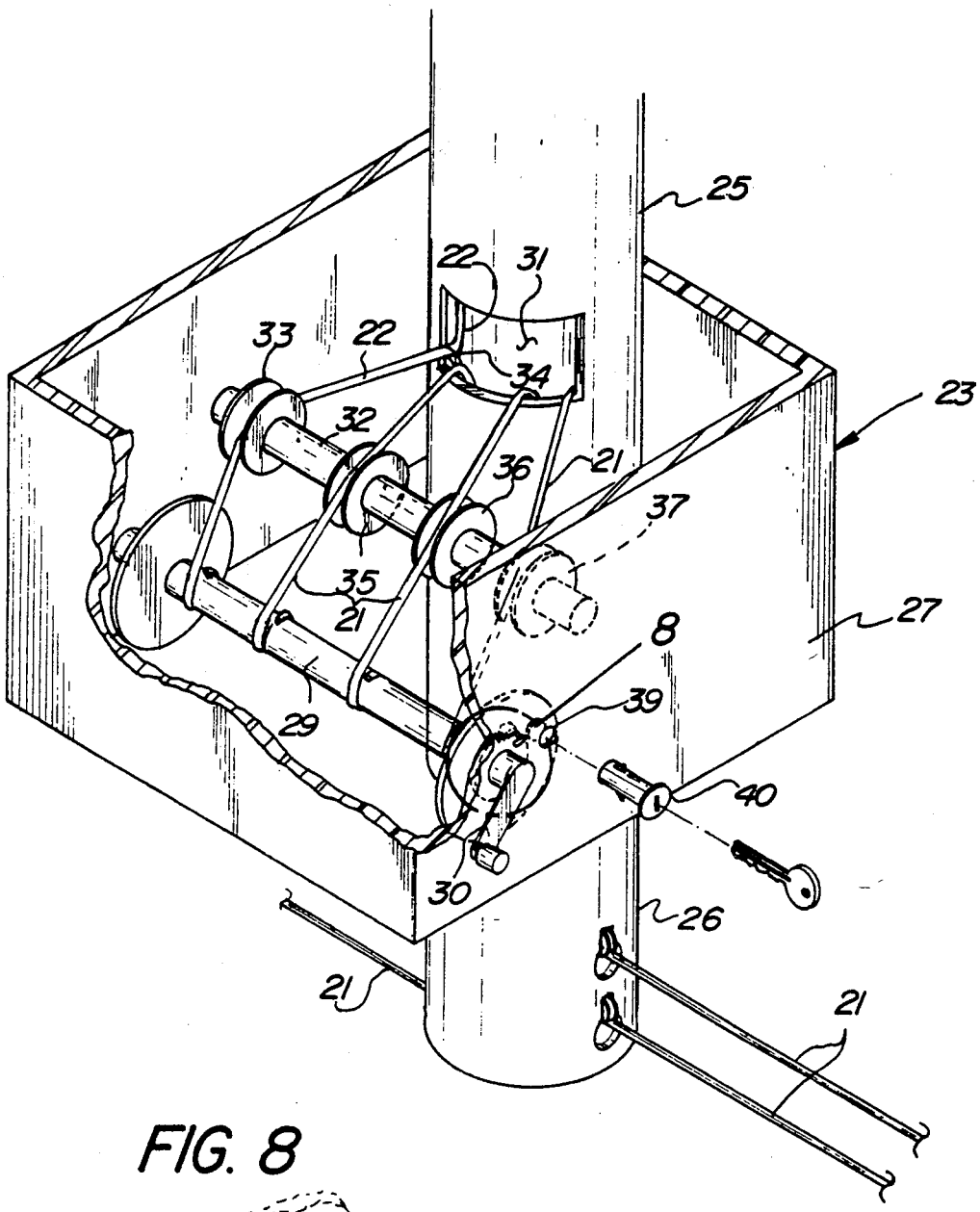
FIG. 7 is an orthographic view, taken along the lines 7—7 of FIG. 6 in the direction indicated by the arrows.

Within the control housing 27 is a first shaft 29 spaced from and parallel a second shaft 32. The first shaft 29 includes the primary control cable 22 secured thereto, as well as the terminal ends of a plurality of secondary control cables 21. The primary control cable 22 extends from the first shaft 29 about a second shaft first pulley 33 and into an upper tube opening 31 directed through the upper tube within the housing 27. The secondary control cables 21 and upper guide bar 34 positioned within the opening 31 receives the primary control cable 22 therebelow to permit directing of the primary control cable 22 through the tube upper portion 25 and exteriorly of an upper opened end of the tube upper portion 25, as illustrated in FIG. 6 for example, and mounted to the outer perimeter cable 20, in a manner as illustrated in FIG. 5, with regard to the secondary control cable 21 in a like mounting arrangement directed through the sheath 18. A plurality of further pulleys to include a second shaft second, third, and fourth pulley 35, 36, and 37 each are arranged to guide an individual secondary control cable 21 secured at one end to the first shaft 29 extending in guidance about the second shaft through an associated pulley through the opening 31 and downwardly through the tube lower portion 26 projecting through the lower tube portion 26 for operative association into a secondary control tube 24, thereafter directed through an upper end of each secondary control tube 24 and subsequently to the outer perimeter cable 20, in a manner as illustrated in FIG. 5. In this manner, winding of each of the primary and secondary control cables 21 and 22 about the central housing first shaft 29 effects the lifting simultaneously of the outer perimeter of the web 13.

Figure 8:
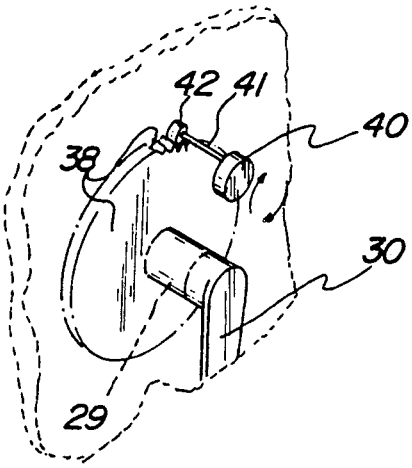
FIG. 8 is a isometric illustration of section 8 as set forth in FIG. 7.

The FIG. 8 illustrates in a somewhat enlarged detail the use of a first shaft circular gear 38 mounted to the first shaft within the housing 27 adjacent the handle 30 and a side wall of the housing 27. The housing includes a housing opening 39 receiving a rotary lock shaft 40, that in turn includes an extension rod 41 projecting to the first shaft circular gear 38 terminating in an extension rod abutment cam 42 that is selectively engageable upon rotation of the rod 41 and the lock shaft 40, with the gear 38 to effect an arresting of the gear as the rotary lock shaft 40 is frictionally retained within the opening 39 in a selective rotative relationship by interfitting of the rotary lock shaft 41 relative to the opening 39.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A swimming pool safety net apparatus, comprising, a swimming pool, with the swimming pool including a continuous side wall, the side wall including a top edge, and the swimming pool including a floor, and the side wall further including a continuous top edge at an upper distal end of the side wall, and a protective flexible web positioned in a first position on the floor and in a second position arranged for displacement adjacent the top edge, and control means in operative communication with the web for effecting displacement of the web from the first position to the second position, and the web includes a plurality of intersecting flexible cables, and the web further including mesh web panels within the intersecting cables, and including an inner perimeter cable mounted coextensively about the mesh web panels, and a sheath extending radially exteriorly of the inner cable, including a sheath cavity, the sheath cavity including an outer cable, and a primary control cable mounted to the outer cable, and a plurality of secondary control cables mounted to the outer cable circumferentially spaced about the outer cable relative to the primary cable.

2. An apparatus as set forth in claim 1 wherein the control means includes a primary control tube and a plurality of secondary control tubes, and each of the secondary control tubes include one of said secondary control cables directed therewithin, and the primary control tube includes the primary cable directed into the primary control tube through an upper distal end of the primary control tube.

3. An apparatus as set forth in claim 2 wherein the primary control tube includes an upper tube portion coaxially aligned with a lower tube portion, and a central housing mounted to the primary control tube in communication with the upper tube portion and the lower tube portion and the primary control tube including a tube opening in communication with the housing, and a first shaft and a second shaft mounted within the housing adjacent the tube opening, with the first shaft and second shaft arranged in a parallel relationship, and the primary control cable directed through the tube upper portion and through the opening and directed about the second shaft and secured to the first shaft.

4. An apparatus as set forth in claim 3 wherein the second shaft includes a first pulley, wherein the first pulley receives the primary control cable directed thereover.

5. An apparatus as set forth in claim 4 wherein the first shaft includes at least one secondary control cable secured thereto, and the second shaft includes a second pulley, wherein the at least one secondary control cable is directed from the first shaft and wound about the second pulley and directed through the opening and downwardly through the tube lower portion, and the at least one secondary control cable directed radially through the tube lower portion and in operative communication through at least one of said secondary control tubes.

6. An apparatus as set forth in claim 5 wherein the first shaft includes a handle fixedly mounted to the first shaft, wherein the handle is positioned exteriorly of the housing adjacent a first side wall of the housing, and the first side wall of the housing including a housing opening directed therethrough, the housing opening including a rotary lock shaft frictionally retained within the housing opening, and rotation means arranged for selective rotation of the rotary lock shaft, and the first shaft including a first shaft circular gear fixedly mounted to the first shaft adjacent the first side wall, the first shaft gear in operative communication with an abutment cam, the abutment cam including an extension rod secured to the abutment cam at a first end of the extension rod and a second end of the central rod secured to the rotary lock shaft, whereupon rotation of the rotary lock shaft effects selective engagement of the abutment cam within the circular gear for arresting rotation of the circular gear and the first shaft.

* * * * *